United States Patent [19]

Timony

[11] 4,175,045

[45] Nov. 20, 1979

[54] COMPRESSOR LUBRICATION

[75] Inventor: Peter E. Timony, Valley Cottage, N.Y.

[73] Assignee: Stauffer Chemical Company, Westport, Conn.

[21] Appl. No.: 881,483

[22] Filed: Feb. 27, 1978

[51] Int. Cl.[2] ..... C10M 3/20

[52] U.S. Cl. ..... 252/56 S

[58] Field of Search ..... 252/56 S

[56] References Cited

U.S. PATENT DOCUMENTS

| | | | |
|---|---|---|---|
| 3,000,827 | 9/1961 | Moler | 252/56 |
| 3,247,111 | 4/1966 | Oberright et al. | 252/56 S |
| 3,694,382 | 9/1972 | Kleiman et al. | 252/56 S |
| 4,049,563 | 9/1977 | Burrous | 252/56 S |

OTHER PUBLICATIONS

"Synthetic Lubricants & Their Application: State of Art", by Miller in National Engineer, Oct. 1976, pp. 26–28.

"Synlubes Head for Mass Market", in Chemical Week, Feb. 5, 1975, pp. 26–29.

"Synthetic Ester Lubricants", by Barnes et al. in Lubrication Engineering, Aug., 1957, pp. 454–456.

*Primary Examiner*—Irving Vaughn

*Attorney, Agent, or Firm*—William C. Gerstenzang

[57] ABSTRACT

An improved method of lubricating a compressor comprises bringing the components of the compressor which are to be lubricated into contact with a synthetic lubricant composition comprising a polyol ester of a carboxylic acid having from about 4 to about 13 carbon atoms in its structure.

9 Claims, No Drawings

COMPRESSOR LUBRICATION

BACKGROUND OF THE INVENTION

This invention relates to the lubrication of compressors, especially air compressors. More particularly, this invention relates to the lubrication of both the air-end and crankcase-end of compressor equipment with polyol ester-based lubricant compositions to extend operating time between oil changes and reduce required maintenance.

The lubrication of compressors, particularly air compressors, poses what is probably the most difficult of all lubricant applications. A desirable lubricant composition for use in compressors should be liquid over a wide temperature range, should have a low vapor pressure, and be operable over an extended period of time at widely ranging temperatures. The viscosity at high temperatures should be sufficient to provide adequate lubrication, and the viscosity at low temperatures should be low enough to allow start-up of the compressor at subzero temperatures without the need for external heating means. It must, of course, be an effective lubricant.

Up to this point, the requirements of a good compressor lubricant parallel those of a good automotive engine lubricant or a good aircraft engine lubricant. There are, however, additional requirements imposed on compressor lubricants which deserve special consideration.

Unlike automotive or aircraft engine lubricants, compressor lubricants are often brought into direct and intimate contact with the gas being compressed. This contact occurs at elevated temperatures and pressures and is repetitive. Thus, for example, in a rotary screw compressor, the gas being compressed becomes intimately mixed with the lubricant which floods the rotating screw elements. This intimate contact usually occurs at elevated temperatures and pressures. Where the gas being compressed is air, the oxygen content of the air in combination with the high pressure and high temperature presents an oxidizing atmosphere which is much more severe than that normally encountered by lubricants in automotive or aircraft engines.

In both engines and compressors, some of the lubricant is exposed to the "process side" of the equipment and is discharged from the equipment along with the other discharge products following such exposure. Thus, in a piston engine, some of the lubricant forms a film on the walls of the combustion chambers of the engine. This oil film may then be consumed by the combustion and/or discharged with the combustion products. These discharge products are almost always waste products, the composition of which is subject only to applicable environmetal guidelines.

In a compressor, especially a rotary screw compressor, some of the lubricant becomes entrained in the air being compressed and is discharged from the compressor along with the compressed air stream. Unlike the discharge product of an engine, however, the discharge product of a compressor is usually a product intended for a specific use, and its composition is generally required to be carefully controlled; it must also be relatively free of oil. It is, therefore, necessary to remove the oil from the air stream. Once the oil is removed from the air stream, it becomes advantageous to recover it and recycle it back to the compressor.

The compressor lubricant is thus continuously recovered from the air stream and recycled back to the compressor where it is subjected to the hostile environment within the compressor on a repetitive basis.

Since compressor lubricants are subject to such multiple exposure to severe operating conditions, oxidative stability becomes one of the most important properties a compressor lubricant must have. This property, in fact, is one of the main factors which determine the useful serve life of a compressor lubricant.

In addition to its effect on the useful service life of the lubricant itself, the oxidative stability of the lubricant also affects the performance of the compressor equipment. One of the most difficult lubricant related problems encountered in compressor equipment is the formation of carbon deposits within the compressor and associated piping. This is caused by oxidation of lubricant contained in the air stream as it passes through the equipment. This particular problem is one of the major maintenance items which require periodic shutdown of compressor systems.

While there are many different types of lubricant compositions known for use in compressors, each of them is deficient in oxidative stability or some other important property.

Mineral oils, for example, are known to be excellent lubricants. Unfortunately, however, the viscosity/temperature relationships of mineral oils are such that at extremely hot temperatures these oils are too thin and at extremely cold temperatures they are too thick; pour points are not low enough. Even those mineral oils containing added viscosity index improvers, pour point depressors, and other additives are not completely satisfactory because they have relatively high volatilities, low flash points, poor thermal and oxidative stabilities, and tend to form carbon and sludge deposits.

Silicone oils offer a number of advantages including good viscosity versus temperature performance, good thermal stability, oxidative stability, and relatively low volatility. The silicones, however, are expensive and are known to be somewhat deficient in their ability to provide lubricity for metal to metal contact. It appears that lubricity of the silicones can be improved through the use of certain additives and that some new silicone compounds have been synthesized which provide good lubricity characteristics. Although they have been used in some compressor applications, the silicones are not being widely used; their high cost and reputation for poor lubricity being discouraging factors.

The silicate esters have excellent viscosity versus temperature characteristics, good thermal stability, wide operating temperature ranges, and low volatility. Their oxidative stabilities, however, are only fair, and these compounds are very unstable in the presence of moisture.

The phosphate esters are relatively good lubricants, are fire resistant, and have low vapor pressures. These fluids are, therefore, attractive candidates for high temperature lubricant applications. Unfortunately, however, the viscosity indices of phosphate esters are relatively poor, and this limits their operating temperature range. In addition, the phosphate esters are expensive and require special sealing materials.

Several diester-based lubricants (i.e., esters of dicarboxylic acids) are now commercially available. These diester fluids are relatively good lubricants and exhibit improved service life in compressors as compared to conventional mineral oil lubricants. The diesters offer relatively high thermal stabilities, wide operating temperature ranges, low pour points, and relatively high flash points. However, even though the oxidative stability of these compounds is better than that of most of the other prior art compressor lubricants, it is still a limiting factor on the service life of the lubricant.

Polyol esters such as carboxylic acid esters of pentaerythritol, dipentaerythritol, or trimethylolpropane, although known to be lubricants which are characterized as having high oxidative stabilities, are not known to be useful as compressor lubricants.

Therefore, a need exists for a method of lubricating a compressor wherein a lubricant capable of extended service-life is used and the incidence of lubricant-related maintenance problems is reduced.

SUMMARY OF THE INVENTION

It is an object of this invention to provide a method of lubricating a compressor, including the crankcase, the air-end, either of them or both of them, wherein the operating time between required oil changes is extended and the incidence of lubricant-related maintenance problems is reduced.

This and other objects are realized in accordance with the present invention by bringing the components of the compressor which are to be lubricated into contact with a synthetic lubricant composition comprising a polyol ester of a carboxylic acid having from about 4 to about 13 carbon atoms in its structure.

DETAILED DESCRIPTION OF THE INVENTION

In accordance with the present invention, there is provided a method of lubricating a compressor which comprises bringing the components of the compressor which are to be lubricated into contact with an effective amount of a synthetic lubricant composition comprising a polyol ester of a carboxylic acid having from about 4 to about 13 carbon atoms in its structure.

This synthetic compressor lubricant composition enables improved long-term lubrication of compressors.

The polyols which may be used in the preparation of polyol esters employed in the method of this invention include, but are not limited to, pentaerythritol, dipentaerythritol, trimethylolpropane, or any combination thereof.

The polyol esters are generally prepared by reacting a polyol with a carboxylic acid. Where a mixture of polyol esters is desired, such a mixture may be prepared by either first preparing the individual polyol esters and then mixing them, or it may be formed by preparing a mixture of polyols and then reacting the mixture of polyols with an acid or a mixture of acids.

Thus, it is within the scope of this invention to employ as the polyol ester a combination of at least two esters selected from the group consisting of pentaerythritol esters, dipentaerythritol esters, and trimethanolpropane esters. Each of these esters may have the same acid moiety or different acid moieties. That is to say, each of the individual polyol esters may be formed by reacting the appropriate polyol with the same acid or mixture of acids; or each individual polyol ester may be prepared by reacting the appropriate polyol with a different acid or mixture of acids; after which, the resulting individual polyol esters are combined to form a polyol ester mixture.

Alternatively, a mixed polyol ester may be formed by forming a premix of polyols and reacting the polyol premix with a carboxylic acid or a mixture of carboxylic acids to form a mixed ester product.

The carboxylic acid used in forming the polyol esters employed in the method of this invention are those carboxylic acids having from about 4 to about 13 carbon atoms in their structure including, but not limited to, butyric acid, valeric acid, hexanoic acid, heptanoic acid, 2-ethyl hexanoic acid, caprylic acid, carpic acid, and mixtures thereof. These acids may be linear, branched or cyclic, and may, of course, be any combination of linear, branched, and cyclic acids.

The particular polyol ester or combination of esters used in the practice of the present invention is selected from the above-defined class of polyol esters in accordance with the particular characteristics desired for any particular application. Thus, for example, a particular polyol or combination of polyols may be reacted with a particular acid or a particular mixture of acids to prepare an ester composition having a predetermined viscosity range or other appropriate physical properties. Such selections will be within the skill of the art.

Thus, for example, it has been found that a lubricant composition which is particularly useful for a rotary compressor, especially a rotary screw compressor, comprises a polyol ester composition comprising from about 50 to about 95% by weight of a pentaerythritol ester of a mixture of linear carboxylic acids each having from about 4 to about 13 carbon atoms in their structure, and from about 5 to about 50% by weight of a dipentaerythritol ester of a mixture of linear carboxylic acids each having from about 4 to about 13 carbon atoms in their structure. Preferably, the mixture of linear carboxylic acids in each case comprises from about 1 to about 2 molar parts of a linear five-carbon carboxylic acid, from about 1 to about 2 molar parts of a linear six-carbon carboxylic acid, and from about 0.5 to about 1.5 molar part of a mixture of linear carboxylic acids consisting essentially of about 60% by weight of eight-carbon carboxylic acid, and about 40% by weight of ten-carbon carboxylic acid.

A particularly preferred pentaerythritol ester lubricant composition within the preceding definition comprises a mixture of about 80 to about 90% by weight of pentaerythritol ester and from about 10 to about 20% by weight of dipentaerythritol ester.

The compressor lubricant composition of the present invention may be prepared by reacting the appropriate polyol or mixture of polyols with the appropriate acid or mixture of acids in the proper ratios. Where the desired product is a mixture of polyol esters and it is desired to prepare each of the esters separately, the esters, once prepared, may be blended by ordinary mixing procedures.

In preparing the polyol esters employed in the present invention by reacting a polyol with an acid as defined above, the reaction is preferably conducted by mixing the components together with a solvent such as naptha, then bringing the mixture to reflux temperature and holding it at reflux temperature for a time sufficient to reflux off most of the water produced as a by-product of the esterification reaction. Once most of the water has thus been removed from the reaction product, the product mixture is distilled to remove all volatiles such as solvent and unreacted acid, and the final product may then be refined by washing with dilute caustic, acid, and water followed by filtration through a filter aid.

In conducting the reaction between the polyol and the acid, it is not necessary to use an esterification catalyst although one may be used. When a catalyst is to be used, a preferred catalyst is stannous octoate. In some cases, however, it may be preferred not to use a catalyst as some esterification catalysts may tend to adversely affect stability of the final ester product.

Although the ester compositions of the present invention are characterized by properties which render them excellent compressor lubricants, many of these properties may be even further improved by the use of various additives. Thus, it is within the scope of the present invention to formulate the ester compositions with suitable lubricity improving agents, extreme pressure agents, anticorrosion agents, rust inhibitors, antioxidants, metal deactivators, antifoam agents, and the like.

As a preferred lubricity and anticorrosion agent, additive amounts of a triarylphosphate, such as tricresyl phosphate, can be blended with the ester compositions used in the practice of this invention. The concentration range of this additive which will be found effective for most applications is from about 1 to about 5% by weight of polyol ester. While there are many rust inhibitors known to those skilled in the art which may be used with the ester compositions of this invention, metal sulfonates, acid phosphonates, and the like are preferred. These rust inhibitors may be used at concentrations ranging from about 0.1 to about 2% by weight of polyol.

Preferred antioxidants are the amine-type antioxidants, particularly phenyl-$\alpha$-naphthylamine and its alkylated derivatives. Measurable improvements in oxidative stability can generally be achieved at antioxidant concentrations ranging from about 0.1% to as much as 2% or more by weight of polyol ester.

Metal deactivators, such as benzotriazole, may be effectively used in extremely low concentration ranges. Typical effective concentration ranges for this additive range from about 0.005 to about 0.1% by weight of polyol ester.

Finally, it is also desirable to include an antifoam agent in the compressor lubricant compositions of the present invention. While there are many commercially available antifoam compositions which may be effectively used, the silicone antifoam agents are preferred. Thus, a typical silicone antifoam used in the ester compositions employed in the practice of this invention is a 60,000-centistoke dimethylsiloxane oil at a concentration ranging from about 1 to about 100 PPM by weight of polyol ester.

In preparing a formulated compressor lubricant composition, the additives may be added directly to the refined ester product and mixed sufficiently to achieve a uniform distribution. In some cases, it is desirable to heat the ester prior to addition of the additives to facilitate solution of the additives in the ester. It is also desirable as an alternative, in some cases, to form an "additive package" for subsequent addition to the ester. Such additive packages may be prepared by, for example, mixing the additives together in a suitable solvent. Suitable solvents for this purpose include toluene, octane, a portion of the polyol ester composition itself, and the like.

In order that the present invention be more fully understood, the following examples are given by way of illustration. No specific details or enumerations contained therein should be construed as limitations on the present invention except insofar as they appear in the appended claims.

EXAMPLE 1

The raw materials used in this preparation were as follows:

(1) Technical pentaerythritol analyzed as having 82.6% by weight of monopentaerythritol, 16.6% by weight of dipentaerythritol, and 0.8% by weight of unknowns.

(2) Dipentaerythritol analyzed as having 1.8% by weight of monopentaerythritol, 88.9% by weight of dipentaerythritol, 6.9% by weight of tripentaerythritol, and 2.4% by weight of unknowns.

(3) n-Valeric acid.

(4) n-Hexanoic acid.

(5) $C_8/C_{10}$ acid mixture analyzed as having 4.5% by weight of n-$C_6$, 58% by weight n-$C_8$, 36.5% by weight of n-$C_{10}$, and 1.0% by weight of n-$C_{12}$.

(6) Stannous octoate.

(7) Naphtha.

A two-liter three-neck round bottom flask fitted with a stirrer, condenser (with nitrogen inlet), water trap, thermometer, and heater was flushed with nitrogen. A positive nitrogen pressure was thereafter maintained on the flask throughout the esterification.

The technical grade pentaerythritol in an amount of 163.3 grams was added to the flask along with 8.1 grams of the dipentaerythritol. (This mixture corresponds to 20% by weight of dipentaerythritol.) Then 191.0 grams n-valeric acid, 217.8 grams n-hexanoic acid, and 191.3 grams of the above-described $C_8/C_{10}$ acid mixture was added followed by 15 ml of napththa.

Finally, a solution of 3 grams stannous octoate in 15 ml napththa was added.

The mixture was heated to reflux and maintained at reflux according to the following schedule:

| Time Elapsed Minutes | Pot Temperature °C. | Total ml $H_2O$ Collected |
|---|---|---|
| 0 | 26 | 0.0 |
| 30 | 167 | 16.0 |
| 37 | 175 | 34.0 |
| 45 | 188 | 52.0 |
| 60 | 197 | 72.5 |
| 73 | 190 | 77.0 |
| 100 | 236 | 80.5 |
| 116 | 238 | 83.0 |
| 295 | 235 | 87.0 |
| 320 | 240 | 87.5 |
| 385 | 245 | 88.5 |
| 505 | 245 | 89.0 |
| 535 | 245 | 89.0 |

Volatiles (31 grams) were then removed at 250° C. and one atmosphere pressure.

The flask's contents were cooled to 70° C. under nitrogen and 500 ml of 10% aqueous sodium hydroxide were added. After stirring for 10 minutes, the aqueous pH remained at 12.

The phases were then separated in a three-liter separating funnel.

The organic layer was then washed with four 500 ml aliquots of water using small amounts of benzene and 2B alcohol to aid phase separation. The pH of the final aliquot of water, after washing, was below 7.

Additional volatiles (benzene, $H_2O$, and ethanol) were removed from the organic phase by evaporation on a rotary film evaporator at 70° C. and 3 mm Hg. The ester was then vacuum stripped to a pot temperature of 175° C. at 0.25 mm Hg. The ester was cooled under nitrogen to 90° C., stirred for 15 minutes with charcoal and powdered alumina, and filtered through a filter-aid.

The final ester product amounted to 578 grams (theoretical: 657 grams) for a calculated yield of 88%. The final material was identified as follows:

| | | | |
|---|---|---|---|
| Refractive Index ($nd^{25}$): | | 1.4505 | |
| Hydroxyl Number: | | 0.0 mg KOH/gm | |
| Acid Number: | | 0.01 mg KOH/gm | |
| Viscosity (centistokes): | | | |
| | 210° F. | (98.9° C.) | 4.88 |
| | 100° F. | (37.8° C.) | 24.54 |
| | −40° F. | (−40° C.) | 6100 |
| after 72 hrs at | −40° F. | | 6087 |

EXAMPLE 2

Using a procedure similar to that described in Example 1, additional esters were prepared using a different lot of the dipentaerythritol and pentaerythritol and varying the total amount of dipentaerythritol. The viscosity of these esters are shown below:

| Ester | Dipentaerythritol (Wt. %) | Viscosity (centistokes) 210° F. (98.9° C.) | 100° F. (37.8° C.) | −40° F. (−40° C.) |
|---|---|---|---|---|
| A | 13.3 | 4.70 | 23.40 | 5635 |
| B | 15 | 4.76 | 23.70 | 5678 |
| C | 15 | 4.76 | 23.55 | 5605 |
| D | 16 | 4.77 | 23.75 | 5686 |
| E | 20 | 5.06 | 25.98 | 6890 |

EXAMPLE 3

A polyol ester was prepared in a pilot plant by a procedure similar to that of Example 1. The polyol ester used was a pentaerythritol/dipentaerythritol mixture having 15% by weight of dipentaerythritol. This ester was blended with additives to form a formulated lubricant composition as follows:

| | Weight Percent |
|---|---|
| Ester | 95.98 |
| Tricresyl Phosphate | 3.00 |
| Phenyl-α-naphthylamine | 1.00 |
| Benzotriazole | 0.02 |
| Silicone Antifoam | 10 PPM |

EXAMPLE 4

The formulated compressor lubricant composition of Example 3 was compared to a commercially available diester-based synthetic compressor lubricant. The comparison was based on standard laboratory procedures for determining the physical properties of lubricants. The results of these comparative tests are shown in the table below:

| COMPARATIVE PROPERTIES | Fluid of Example 3 | Diester-Based Fluid |
|---|---|---|
| Viscosity (ASTM D445) at: | | |
| 210° F. (98.9° C.), cs | 4.88 | 5.43 |
| 100° F. (37.8° C.), cs | 25.2 | 29.8 |
| −40 20 0 F. (−40° C.), | 7650 | 20597 |
| Pour Point (ASTM D97), | | |
| °F. | −55 | −45 |
| °C. | −48 | −43 |

-continued

| COMPARATIVE PROPERTIES | Fluid of Example 3 | Diester-Based Fluid |
|---|---|---|
| Autogenous Ignition Temperature, °F. | 810 | 810 |
| Evaporation Rate (ASTM D92), % Loss (after 22 hrs at 300° F. (149° C.) ) | 0.4 | 0.8 |
| Shell 4-Ball Wear (ASTM D2266), (1 hr, 600 RPM, 54° C.), Scar Diameter, mm at: | | |
| 1 kg Load | 0.11 | 0.19 |
| 10 kg Load | 0.30 | 0.37 |
| 40 kg Load | 0.42 | 0.56 |
| Oxidation-Corrosion Stability (FTMS No. 79, Method 5308), (72 hrs at 347° F. (175 ° C.), 5 1/hr air), | | |
| Acid Number Increase | 0.14 | 1.28 |
| % 100° F. (37.8° C.) Viscosity Increase | 2.7 | 4.6 |
| Method Corrosion, mg/cm²: | | |
| Magnesium | 0 | +0.02 |
| Steel | −0.05 | 0 |
| Aluminum | 0 | 0 |
| Silver | 0 | −0.06 |
| Copper | +0.06 | 0 |

It will thus be seen that the synthetic lubricant compositions and method of lubricating a compressor in accordance with the present invention provide for the long-term lubrication of compressors. The synthetic compressor lubricant compositions of this invention have superior physical properties such as low volatility, excellent lubricity, excellent oxidative stability, good temperature/viscosity relationships, and low pour point which enable them to provide excellent lubrication to compressors over extended periods of time despite exposure to extremely severe operating conditions. These lubricants are convenient to use since they can be used in both the "air-end" and crankcases of compressors.

The objects set forth above, among those made apparent from the preceding description, are therefore effectively attained and, since certain changes may be made in the above process without departure from the steps of the invention, it is intended that all matter contained in the above description shall be interpreted as illustrative and not in a limiting sense.

What is claimed is:

1. A method of lubricating a compressor which comprises bringing the components of said compressor which are to be lubricated into contact with an effective amount of a synthetic lubricant composition comprising a polyol ester of a carboxylic acid having from about 4 to about 13 carbon atoms in its structure.

2. The method of lubricating a compressor in accordance with claim 1 wherein said polyol ester is a pentaerythritol ester, a dipentaerythritol ester, a trimethylolpropane ester, or any combination thereof.

3. The method of lubricating a compressor in accordance with claim 1 wherein said polyol ester is a combination of at least two esters selected from the group consisting of pentaerythritol esters, dipentaerythritol ester, and trimethylolpropane esters; each ester having an acid moiety which can be the same or different from the acid moiety of any other ester in said combination.

4. The method of lubricating a compressor in accordance with claim 1 wherein said polyol ester is a mixed ester formed by reacting a mixture of at least two polyols selected from the group consisting of pentaerythritol, dipentaerythritol, and trimethylolpropane with a carboxylic acid selected from the group consisting of linear carboxylic acids having from about 4 to about 13 carbon atoms in their structure or a mixture of such acids.

5. A method of lubricating a compressor which comprises bringing the components of said compressor which are to be lubricated into contact with an effective amount of a synthetic lubricant composition comprising a major amount of a pentaerythritol ester composition, said pentaerythritol ester composition comprising:

(1) from about 50 to about 95% by weight of a pentaerythritol ester of a mixture of linear carboxylic acids, each having from about 4 to about 13 carbon atoms; and (2) from about 5 to about 50% by weight of a dipentaerythritol ester of a mixture of linear carboxylic acids, each having from about 4 to about 13 carbon atoms.

6. The method in accordance with claim 5 wherein said mixture of linear carboxylic acids comprises from about 1 to about 2 molar parts of a linear 5-carbon carboxylic acid, from about 1 to about 2 molar parts of linear 6-carbon carboxylic acid, and from about 0.5 to about 1.5 molar part of a linear carboxylic acid having from 8 to 10 carbon atoms or any combination of linear 8-carbon to 10 carbon carboxylic acids.

7. The method in accordance with claim 6 wherein said pentaerythritol ester composition is comprised of from about 80 to 90% by weight of said pentaerythritol ester and from about 10 to about 20% by weight of said dipentaerythritol ester.

8. The method in accordance with claim 7 wherein said compressor is a rotary compressor.

9. The method in accordance with claim 8 wherein said rotary compressor is a rotary screw compressor.

* * * * *

UNITED STATES PATENT AND TRADEMARK OFFICE

CERTIFICATE OF CORRECTION

PATENT NO. : 4,175,045

DATED : November 20, 1979

INVENTOR(S) : Peter E. Timony

It is certified that error appears in the above-identified patent and that said Letters Patent are hereby corrected as shown below:

Col. 2, line 8 - "serve" should be "service".

Col. 6, line 31 - "napththa" should be "naphtha".

Col. 6, line 34 - "napththa" should be"naphtha".

Col. 7, line 65 - "-40 20 0 F.(-40° C.)." should be "-40°F. (-40°C.)."

Signed and Sealed this

*Eighteenth* Day of *March 1980*

[SEAL]

*Attest:*

SIDNEY A. DIAMOND

*Attesting Officer*

*Commissioner of Patents and Trademarks*